252-103 AU 157 EX
6/10/86 XS 4,594,175

United States Patent [19]
Copeland

[11] Patent Number: 4,594,175
[45] Date of Patent: Jun. 10, 1986

[54] MECHANICAL DISHWASHING RINSE COMPOSITION HAVING A LOW FOAMING SULFONIC ACID RINSING AGENT, A HYDROTROPE AND A SOURCE OF ACTIVE HALOGEN

[75] Inventor: James L. Copeland, Burnsville, Minn.

[73] Assignee: Economics Laboratory, Inc., St. Paul, Minn.

[21] Appl. No.: 646,256

[22] Filed: Aug. 29, 1984

[51] Int. Cl.[4] ..... C11D 7/18
[52] U.S. Cl. ..... 252/99; 252/102; 252/103; 252/106; 4/228
[58] Field of Search ..... 252/95, 99, 102, 103, 252/106, DIG. 2, DIG. 14

[56] References Cited

U.S. PATENT DOCUMENTS 3,692,684 9/1972 Hentschel ..... 252/99
3,929,661 12/1975 Nakagawa et al. ..... 252/103
3,985,668 10/1976 Hartman ..... 252/99
4,071,463 5/1976 Steinhauer ..... 252/103
4,271,030 6/1981 Brierley ..... 252/95
4,308,625 8/1980 Kitko ..... 4/228

*Primary Examiner*—Paul Lieberman
*Assistant Examiner*—John F. McNally
*Attorney, Agent, or Firm*—Merchant, Gould, Smith, Edell, Welter & Schmidt

[57] ABSTRACT

A low foaming rinse composition that can be used in spray warewashing machines to provide sanitation, bleaching, and rinsing can comprise in an aqueous base a sufficient bleaching-sanitizing amount of an active-halogen composition and a sulfonate rinse agent, optionally in the presence of a threshold agent. The sulfonate rinse agent is a $C_{1-9}$ alkyl benzene sulfonic acid or sulfonate composition which is stabilized in solution by a hydrotrope.

9 Claims, No Drawings

MECHANICAL DISHWASHING RINSE COMPOSITION HAVING A LOW FOAMING SULFONIC ACID RINSING AGENT, A HYDROTROPE AND A SOURCE OF ACTIVE HALOGEN

FIELD OF THE INVENTION

The invention relates to aqueous, low foaming, active halogen containing rinse solutions and compositions, rinse concentrates and methods of their use and preparation. More particularly the invention relates to rinse solutions and compositions having a sulfonate rinse agent and a source of active halogen or active halogen composition, which provide a rinsing action and stain removal or bleaching in the substantial absence of foam.

BACKGROUND OF THE INVENTION

In household, commercial, industrial or institutional warewashing or dishwashing commonly available dishwashing machines have mechanical spray mechanisms in which ware are sprayed first with a cleaning solution and second with a rinsing solution. This functional design is substantially different than the design of a household laundry machine in which objects to be cleaned are immersed in a cleaning medium. Typically, in spray washers both the cleaning solutions and rinsing solutions are held in a machine reservoir, pumped to a spray mechanism where the cleaning or rinsing solution is directed under pressure onto the ware, and after cleaning or rinsing the solution returns to the reservoir. Such spray mechanical washers can operate with a variety of combinations of cleaning, rinsing and other steps. However most machines operate with one or more steps of the following sequence: scraping, rinsing, washing, rinsing, and sanitizing. Commonly machines are classified by the temperature of their cleaning and rinsing. High temperature machines use thermal energy to achieve a sanitizing action while low temperature machines use chemical sanitizing agents. In high temperature machines a minimum of two operations are required. The ware is contacted at high temperature (140°-180° F.) with an alkaline low foaming cleaner solution and are then rinsed with water at a sanitizing temperature which contains a rinse aid to promote drying with a minimum of spotting or filming. In low temperature machines, the ware are contacted with hot tap water containing an alkaline low foaming cleaner solution and are then rinsed with hot tap water (120°-140° F.) which contains a rinse agent and are contacted with an active halogen composition to achieve acceptable sanitization. The concentration of active halogen required to achieve effective sanitization typically falls within the range of about 50-100 parts of available halogen or chlorine per million parts of the rinse composition.

Typically, alkaline cleaners used in mechanical spray warewashing machines can be liquid, granular or solid in form. These high performance cleaners commonly contain active cleaning agents such as alkaline ingredients including alkali metal hydroxide, phosphates, silicates, chlorine yielding compounds, defoamers and organic threshold or chelating agents. See, for example, the disclosures of Mizuno et al, U.S. Pat. No. 3,166,513; Sabatelli et al, U.S. Pat. No. 3,535,285; Sabatelli et al, U.S. Pat. No. 3,579,455; Mizuno et al, U.S. Pat. No. 3,700,599; and Copeland et al, U.S. Pat. No. 3,899,436 for a discussion of such high performance cleaners.

The active-halogen or halogen oxidant bleach compositions can be present in the alkaline cleaners or can be separately added with the alkaline cleaner to provide a bleaching sanitizing effect during a cleaning cycle. The use of active halogen compositions in high performance cleaners in the cleaning cycle suffers from certain drawbacks. First, the active halogen compositions often interact with the components of the highly alkaline cleaners, reducing the effective concentration of active-halogen and the halogen-reactive cleaner components. Second, the pH of solutions containing the cleaning agents reduces the effectiveness of the active halogen composition. In a chlorine based halogen bleach, the active agent is commonly hypochlorous acid (HOCl). In an aqueous system the dissociation of hypochlorous acid is a function of pH. For example at pH 8, 21% of the hypochlorous acid is undissociated whereas at pH 11 about 0.03% is unassociated. At equal concentration of the source of halogen at pH 8 there is nearly 700 times as much hypochlorous acid available to bleach stains and sanitize surfaces than is available at pH 11. Third, in the cleaning cycle a majority of the halogen is consumed in non-stain removing or non-sanitizing reactions. A substantial excess of the active halogen composition is commonly present in the cleaning composition since the active halogen comes in contact with a large concentration of readily oxidizable organic materials which can rapidly react with halogen and reduce the concentration of active halogen. A large excess of active halogen composition is used to insure that at least some active halogen remains in the cleaner solution to destain and sanitize the tableware after the majority of the active halogen compound interacts with and is absorbed or reduced by organic soil. The use of substantial quantities of active halogen composition in the cleaner is an uneconomic waste of the chemical. Clearly, a clear economic and operation benefit can result from the removal of relatively large amounts of active halogen compositions from the cleaning compositions added to the wash cycle.

In view of the above, combining a rinse agent with an active halogen in a rinse cycle would prevent problems that arise during the use of active halogen compound in the cleaner solutions. One option involves separately metering the rinse agent and active halogen composition into the rinse cycle of the warewashing machine. However, this would result in an uneconomic duplication of metering systems. Accordingly, for economic and practical reasons a substantial need exists for a rinse composition which combines a rinse agent and an active halogen composition.

Rinse agents or sheeting agents are low foaming compounds commonly added to rinse water to produce a rinsing or sheeting action, to insure substantial rinse water removal and to aid in the prevention of spotting. The precise mechanism through which rinse agents cause the rinse water to form continuous sheets of water which drain cleanly from the surface is unknown. Commonly available commercial rinse agents typically comprise a low foaming surface active agent made from homopolymers or copolymers of an alkylene oxide such as ethylene oxide or propylene oxide or mixtures thereof. Typically the surfactants are formed by reacting an alcohol, a glycol, a carboxylic acid, an amine or a substituted phenol with various proportions and combinations of ethylene oxide and propylene oxide to form both random and block copolymer substituents. Rinse agents containing substituents formed from an alkyleneoxide are particularly sensitive to rapid degradation in the presence of active halogen compounds. Accordingly, the combination of active halogen with the majority of presently available commercial rinse compositions in the rinse cycle would result in degradation of both rinse agent and active halogen.

Rinse agents and other components of rinse compositions desirably have certain characteristics. The rinse agent must be soluble in an aqueous solution of active halogen composition. The rinse agent must not cause the consumption or degradation of more than about 25 wt-% and preferably less than 10 wt-% of the original active halogen composition. The active halogen must not in turn degrade the rinse agent. Further, the rinse agent compositions must produce a substantial and complete sheeting effect in the final rinse. The rinse composition must be substantially resistant to the production of large amounts of foam. Foaming is a substantial drawback in machine spray washers using a pump that transfers rinse solution from the reservoir to the spray mechanism. The pumps used in the machines are designed to efficiently move water which is substantially noncompressable, but cannot move foam which is substantially highly compressable air. In the presence of foam, the delivery of rinse water can be prevented, and in extreme cases the presence can result in damage to the pump.

BRIEF DESCUSSION OF THE INVENTION

We have found a low foaming sanitizing rinse agent for low temperature and high temperature machine warewashing which comprises in an aqueous base, a sufficient bleaching-sanitizing amount of a source of active halogen composition, an effective low foaming rinse agent comprising an alkyl benzene sulfonic acid compound or sulfonate salt thereof, and a sufficient amount of a sulfonic acid hydrotrope to maintain the sulfonic acid in solution in the rinse composition, which provides rinsing with little foam and is both chemically an physically compatible during storage with the active halogen composition.

Surprisingly, we have found that the alkyl benzene sulfonic acid or sulfonate rinse aid provides all required properties, solubility in the solution of active halogen composition, sheeting, reduced foam production, and chemical compatibility with active halogen compositions for extended periods of time in the absence of substantial degradation of either the surfactant or the active halogen composition. In the context of this invention "rinse agent" refers to the alkyl benzene sulfonic acid composition, "sulfonic acid rinse agent hydrotrope" refers to any compound or class of compound that can act as a hydrotrope for the sulfonic acid rinse agent, "rinse composition" refers to the concentrate composition of water, the rinse agent the active halogen compound, and "rinse solution" refers to the fully dilute aqueous solution sprayed on the ware within the machine spray warewasher.

Sulfonic Acid Rinse Agent

The alkyl benzene sulfonic acid surfactants useful in the rinse agent composition of the invention include compounds and mixtures of compounds of the formulae:

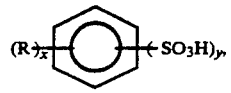

and the alkali and alkaline earth metal salts thereof, wherein x is independently an integer of 1 to 4 and y is independently an integer of 1 to 4, the sum of x and y is less than or equal to 5, and the average number of carbon atoms in the R or alkyl groups is 8 or less. The alkyl group can be an aliphatic straight chain group, a secondary or a tertiary group. Examples of typical alkyl groups include methyl, ethyl, n-propyl, isopropyl, n-butyl, t-butyl, amyl, t-amyl, hexyl, 2-ethyl hexyl, n-octyl, n-nonyl, etc. Preferably each R is independently an alkyl group of 1 to 9 carbon atoms, each x is independently an integer of 1 or 2, and each y is independently an integer of 1 or 2. Most preferably, x is about 1 and y is about 1, and each R is independently an alkyl group of 2 to 8 carbon atoms. The rinse agents of the invention are complex mixtures of alkyl benzene sulfonic acids that can have substantial proportions of dialkylate and disulfonate. Preferred alkyl groups can be derived from a propylene oligomer having 2 or 3 propylene moieties or various alpha olefin sources and can have 3 to 8 carbon atoms.

Hydrotrope Solubilizer

Hydrotrophy is a property that relates to the ability of materials to improve the solubility or miscibility of substances in liquid phases in which the substance tends to be insoluble. Substances that provide hydrotrophy are called hydrotropes and are used in relatively high concentrations, about equal proportions or less of the hydrotrope, to modify in some way the solvent to increase the solubility of an insoluble substance or by creating a micellar or mixed micellar structure resulting in a stable suspension of the insoluble substance in the solvent. The hydrotropic mechanism is not thoroughly understood. Apparently either hydrogen bonding between primary solvent, in this case water, and the insoluble substance are improved by the hydrotrope or the hydrotrope creates a micellar structure around the insoluble composition to maintain it in solution. In this invention, the hydrotropes are most useful in maintaining the uniform solution in the rinse composition. The alkyl benzene sulfonate rinse agent tends to be unstable in solution and can undergo a phase change or phase separation during storage. The hydrotrope solubilizer maintains the rinse composition in a single phase solution having the sulfonate rinse agent uniformly distributed throughout the composition.

Preferred hydrotrope solubilizers include xylene sulfonate hydrotropes. Xylene sulfonates commonly do not provide any sheeting effect or surfactant effect, but significantly improve the solubility of $C_{1-8}$ alkyl benzene sulfonic acid or sulfonates in the solution of active halogen composition.

Active Halogen Composition

Organic and inorganic sources of the active halogen composition can be used in the rinse agents of the invention. The sources of active halogen composition or halogen-oxidant bleach must be compatible and stable in aqueous solution or suspension. Further, they must not interact with the sulfonate rinse agent of the invention producing physical separation of the rinse agent components or chemical degradation. The strength of an aqueous solution containing the active halogen composition is measured in terms of available halogen calculated as $X_2$ wherein X can be F, Cl, Br, or I, preferably X is Cl or Br. Most preferably X is Cl. Available halogen, commonly means to persons skilled in the art, the ability of the solution to liberate halogen in a solution. Such ability is also called oxidizing power.

Organic sources of active halogen which can be useful at dilute (1–2%) concentration include chloramines, chlorimines, chloramides, chlorimides, such as potassium dichloroisocyanurate, sodium dichloroisocyanurate, sodium dichloroisocyanurate dihydrate, trichlorocyanuric acid, 1,3-dichloro-5,5-dimethylhydantoin, n-chlorosulfamide, chloramine-T, dichloramine-T, chloramine-B, and dichloramine-B, etc. and mixtures thereof. Organic agents are commonly non-stable in aqueous solutions above 1–2% by weight since the HOCl generated by the organic source of active-halogen can attack functional groups in the organic portin of the source.

Preferred active halogen compositions of this invention include inorganic sources of halogen such as inorganics that produce halogen as $X_2$, $OX^-$, HOX, etc., wherein X is Br or Cl. Such inorganic bleaching agents include alkali metal hypohalite, monobasic calcium hypohalite; dibasic magnesium hypohalite; halogenated condensed phosphates, their hydrated species, and mixtures thereof. The most preferred active halogen composition can yield hypochlorite species in aqueous solution at appropriate pH. The hypochlorite ion can be chemically represented as:

$$OCl^-.$$

Examples of hypochlorite yielding compounds include alkali metal and alkaline earth metal hypochlorites including lithium hypochlorite, sodium hypochlorite, potassium hypochlorite, monobasic calcium hypochlorite, dibasic magnesium hypochlorite, etc. and mixtures thereof.

Threshold Agents

Threshold agents (i.e. complexing agents, sequestering agents), that can be used in the invention to prevent the precipitation of hardness components in service water can be used in the novel rinse agent compositions of the invention. Commonly service water used in the rinse cycle to dilute the rinse composition to form the rinse solution can have substantial proportions of hardness components, commonly calcium and magnesium ions, which in the presence of certain rinse agents can precipitate and leave unsightly deposits of mixed calcium and magnesium salts, generally in the form of a carbonate. These deposits can often include other hardness components such as ferrous or ferric compounds and other common cations. Threshold agents act to prevent or delay crystal growth of the calcium or magnesium compounds. While the threshold mechanism is unknown, the threshold agents are used at a concentration substantially less than an amount that would be stoichiometric with the hardness components. However, greater than trace amounts of threshold agent are known to thermodynamically delay crystal growth.

Such threshold agents can be both organic and inorganic but must be resistant to reaction with the halogen oxidizing compound and must not have an undesirable rinse action inhibiting interaction with the sulfonate rinse agent. The most common or widely used threshold agents are those that coordinate metal ions through oxygen or nitrogen donor atoms or groups containing oxygen or nitrogen atoms. Typical organic complexing agents include, for example, N-hydroxyethylaminodiacetic acid, nitrilotriacetic acid, ethylene diamine tetraacetic acid, and its mono, di, tri and tetrasodium salts, maleic anhydride, polyacrylic acid or polymethacrylic acid, homo or interpolymers, and mixtures thereof. Examples of inorganic threshold agents include condensed phosphates having the following general formula:

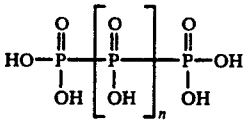

wherein, n is greater than or equal to 1, preferably n = 1 to 4, and the alkali metal or alkaline earth metal salts thereof.

The preferred threshold agents for use in the rinse agent of the invention comprises polyacrylic homopolymers and interpolymers having pendent carboxyl groups and a molecular weight of about 500 to about 5,000. These threshold agents have been found to be effective in complexing hardness components of service water and have been found to be stable in the presence of strong chlorine bleaches and soluble in the presence of substantial quantities of sulfonate surfactant.

In addition to the above-described active-halogen composition, sulfonate rinse agent and threshold agent, the novel rinse agent compositions of the invention can contain optional components that can enhance performance, stability, aesthetic appeal, processing, packaging, or consumer acceptance. Such materials include optional coloring agents and perfumes. These materials should be selected from dyes and perfume varieties which are stable against degradation in the presence of strong active halogen agents.

The rinse compositions of the invention can be prepared by admixing each of the above-described components in an appropriate concentration in essentially any order to form a concentrate which can be metered into the reservoir forming a rinse solution in the machine dishwasher in order to provide an effective concentration of the components to clean, sanitize, and cause sheeting action in the rinse cycle. Commonly the concentration of the active halogen composition composition present in the final rinse solution should range from about 1 to 200 parts of active halogen composition per million parts of rinse water for an effective sanitizing-bleaching or stain removing action. Preferably the concentration of active halogen composition ranges from about 2 to 100 parts of active halogen, and most preferably, for reasons of economy and effectiveness, a concentration of active halogen ranges from about 10 to 50 parts of active halogen in the form of hypochlorite, per million parts of rinse water.

Similarly, the concentration of sulfonate rinse agent in the final rinse water should range from about 1 to 200 parts of sulfonate rinse agent per million parts of rinse water to obtain sufficient sheeting action to result in substantially complete rinsing of the tableware. Preferably, the concentration of the sulfonate rinse agent ranges from about 2 to 100 parts of sulfonate rinse agent, and most preferably, for reasons of economy and effective rinsing, the concentration of the sulfonate rinse agent ranges from about 10 to 80 parts of the sulfonate rinse agent per million parts of the final rinse water.

The concentration of the hydrotrope solubilizer for the sulfonate rinse agent in the final rinse water should range from about 1 to about 200 parts of the hydrotrope per million parts of rinse water. Preferably the concentration of hydrotrope ranges from about 2 to 100 parts of hydrotrope, and most preferably the concentration of the hydrotrope ranges from about 10 to 80 parts of the sulfonate rinse agent per million parts of final rinse water.

The concentration of the threshold agent commonly depends on the concentration of hardness components (commonly less than 200 ppm) in service water provided by local water utilities. The concentration of the threshold agent should be maintained in an amount of agent to inhibit or reduce the rate of the precipitation of hardness components in the rinse solution. Commonly service water in most locales can be successfully treated if the concentration of the threshold agent is maintained at less than 150 parts of threshold agent per million parts of total final rinse water. However, should deposits of calcium and magnesium carbonate appear on tableware, the concentration of the threshold agent can be augmented. Preferably the concentration of the threshold agent in the final rinse composition for use in most available service water (hardness of 150 ppm or less) ranges from about 0.2 to 25 parts of the threshold agent, and most preferably, for reasons of high performance and economy, the concentration of the threshold agent ranges from about 0.5 to 10 parts of the threshold agent per million parts of the final rinse water.

Commonly concentrates of the components can be prepared which can be diluted at a ratio to provide a final rinse water having active components within the above concentrations by forming in an aqueous base a rinse agent concentrate containing from about 0.1 to 15 wt-% of a source of the active halogen (halogen-oxidizing bleach) composition capable of releasing active halogen into the aqueous solution, about 0.1 to 15 wt-% of the sulfonate surfactant, about 0.1 to 15 wt-% of the hydrotrope stabilizer, and optionally about 0.1 to 20 wt-% of the threshold agent. Preferably, the rinse agent concentrates of the invention contain sufficient active halogen compounds to provide about 0.5 to 10 wt-% of active halogen composition, in combination with about 0.5 to 12 wt-% of the sulfonate surfactant, about 0.5 to 12 wt-% of the hydrotrope, and optionally about 0.5 to 15 wt-% of the threshold agent. Most preferably, the rinse agent of the invention contains about 1 to 7.5 wt-% of sodium hypochlorite, about 1 to 10 wt-% of the sulfonate surfactant, about 1 to 10 wt-% of the hydrotrope and about 1 to 10 wt-% of a polyacrylic acid threshold agent having a molecular weight of about 300 to 5,000.

The above-described rinse agents can be used in institutional, industrial and household dishwashing machines that have the capability of injecting controlled amounts of the rinse agent into a final rinse water. The rinse composition of the invention can be metered into a machine dishwasher at a ratio of one part of the rinse composition per each 4,000 or more total parts of rinse solution. Preferably the ratio is one part of rinse composition per each 5,000 to 100,000 parts of the final rinse solution, depending on the concentration of the components in the rinse composition concentrate.

In household and commercial operations, washing of dishware comprises at a minimum two stages, a washing cycle and a rinsing cycle. An optional first stage in which larger agglomerates of foods can be removed from the dishes which is commonly called a scraping or first stage cycle, water is maintained at a temperature of from about 100° to 120° F. in order to effectively remove large food agglomerates.

A washing cycle is usually performed using aqueous solutions or suspensions of highly alkaline cleaners with water at an elevated temperature. The washing cycle can commonly be performed at relatively low temperature, i.e. 120°-160° F. or at relatively high temperature, commonly 160°-200° F. The rinse cycle or last stage of the dishwasher operation is usually maintained at a temperature that ranges from 120°-200° F. depending on the need to use high temperature sanitizing. Typically food soil load is highest in the optional scraping or preparatory cycle, lower in the wash cycle and is negligible in the rinse cycle except for staining that is generally physically associated or chemically bonded into the surface of the ware.

In order to conserve heat and water it is customary to feed back used rinse water into the wash or scraping stage. Generally, the wash or rinse water commonly contains low concentrations of rinse additive due to dilution by water.

The following Examples further provide a basis for understanding the invention and include a best mode.

EXAMPLE I

Into a 2,000 mL glass beaker equipped with magnetic stirrer was placed 250.0 grams of soft water. Into the water under stirring was added 625.0 grams of an 8.0 wt-% aqueous solution of sodium hypochlorite (NaOCl) and the mixture was stirred until uniform. Into the uniform solution was added 125 grams of a 40 wt-% aqueous solution of a sodium butyl benzene sulfonate (10% dialkylate and about 98.3% disulfonate). After the addition was complete and the mixture was uniform, the pH was adjusted to 11.5 with 50 wt-% aqueous sodium hydroxide. During addition of the components, the temperature was maintained between 60°-80° F.

EXAMPLE II

Into a 2,000 mL glass beaker equipped with a magnetic stirrer was placed 280 grams of soft water. Into the water under stirring was added 600 grams of an 8 wt-% aqueous solution of sodium hypochlorite (NaOCl) and the mixture was stirred until uniform. Into the uniform solution was added 120 grams of a 45 wt-% solution of a sodium alkyl diphenyl oxide sulfonate (90% monoalkylate and greater than 90% disulfonate) wherein the alkyl groups are $C_{10}$ linear groups, made from an alpha olefin. After the mixture was uniform, the pH was adjusted to 11.5 with 50 wt-% aqueous sodium hydroxide. During blending the temperature was maintained between 60° and 80° F.

EXAMPLE III

Into a 2,000 mL glass beaker equipped with a magnetic stirrer is placed 160 grams of soft water. Into the water under stirring is added 600 grams of an 8 wt-% aqueous solution of sodium hypochlorite (NaOCl) and the mixture is stirred until uniform. Into the uniform solution is added 120 grams of 45 wt-% solution of sodium butyl benzene sulfonate. Also added is 120 grams of a 45 wt-% solution of a sodium xylene sulfonate (about 10% disulfonate). After the mixture was uniform, the pH is adjusted to 11.5 with 50 wt-% aqueous sodium hydroxide. During blending the temperature was maintained between 60° and 80° F.

TABLE 1

| | | Sheeting Evaluation | |
|---|---|---|---|
| | | Concentration for Continuous Water Sheeting* | |
| Product of Example | Temperature | Glass | #316 Stainless Steel |
| I | 160° F. | 800 ppm (40 ppm)** | 1600 ppm (80 ppm) |
| II | 160° F. | 450 ppm (22.5 ppm) | 1300 ppm (65 ppm) |
| Pluronic 25R2 | 160° F. | (90 ppm) | (100 ppm) |

*Concentration of rinse composition for continuous films of water to be formed over surface under evaluation.
**Concentration in (.) is active surfactant concentration.

TABLE 2

| | Foaming Evaluation (Dynamic Foam) | | |
|---|---|---|---|
| Product of Example | Concentration | Foam Height | Temperature |
| I | 500 ppm | 3 inches | 120° F. |
| I | 500 ppm | 3 inches | 160° F. |
| II | 500 ppm | 6 inches | 120° F. |
| II | 500 ppm | 6 inches | 160° F. |

TABLE 3

| | Chlorine Stability 240 Hours at 100° F. | | |
|---|---|---|---|
| Product of Example | Initial Chlorine | Final Chlorine | Percent Remaining |
| I | 5.03 | 4.4 | 87.5 |
| II | 4.78 | 4.60 | 96.2 |
| Control* | 5.0 | 4.75 | 95.0 |

*5.0% NaOCl solution with pH adjusted to 11.50.

The data presented in Table 1 entitled "Sheeting Evaluation" was obtained using a Champion 1-KAB machine dishwasher. Test pieces were placed in the machine having a glass door to permit visual observation of the test pieces and having wash and rinse temperatures of about 160° F. For the evaluation the test pieces were washed in soft water three times on automatic cycle using 200 grams of a detergent prepared by blending 30 wt-% sodium metasilicate, 35% sodium tripolyphosphate, 3 wt-% PLURAFAC surfactant No. RA-43, and 32% sodium carbonate. During the three wash cycles no rinse additive was used. To determine the sheeting effect the machine was filled with water and set on manual. Into the water was added 500 parts of Mazola corn oil per million parts of rinse water, and a minimum measured amount of rinse composition of the Examples. The mixture was circulated for 3 minutes and the concentration of rinse additive was progressively increased by injecting increasing amounts of rinse composition until a substantially continuous sheeting effect of the rinse water was noted over substantially all the test pieces. The minimum concentration for continuous sheeting was noted and recorded in Table 1.

The data recorded in Table 2 entitled "Foaming Evaluation (Dynamic Foam)" was generated in a foam test device which is a cylindrical container 8 liters in volume, 15 centimeters in diameter and 50 centimeters in height equipped with an electric hot plate for temperature control, a pump to recirculate the test solution at 6 psi through a means to direct a spray of the test solution onto the surface of the contents of the solution to generate foam.

Three liters of a test solution prepared in soft water which contained 6.0 grams of a dry blend of 30 wt-% sodium metasilicate, 35 wt-% sodium tripolyphosphate, 3% PLURAFAC RA-43 and 32 wt-% sodium carbonate was used (2000 ppm in the aqueous detergent). The rinse compositions of the Examples were evaluated at 500 parts per million by adding 1.5 grams of the rinse composition of each invention to 3 liters of th test detergent. The tests were performed by recirculating the detergent solution through the spray means in the dynamic foam tester for 5 minutes to verify that the initial equilibrated foam was no more than ½ inch above the surface of the test solution. After the equilibrated foam level was established the rinse composition was added to the test solution and after 5 minutes, the foam height was measured.

The chlorine stability test was performed by placing about 400 milliliters of the fully compounded rinse additive composition in a capped translucent polyethylene bottle which was stored or 240 hours at 100° F. The chlorine concentrations were measured by a standard iodometric titration with thiosulfate. An examination of the Tables shows that the rinse additive composition of the invention (Example I) had acceptable sheeting properties, generated ½ inch of foam at both 120° and 160° F., and contained stable chlorine.

The above Examples, data, and specification provide a basis for understanding the invention. However, since many embodiments of the invention can be made without departing from the spirit and scope of the invention, the invention resides wholly in the claims hereinafter appended.

I claim:

1. A low-foaming and sanitizing or bleaching rinse solution for machine warewashing which consists essentially of:

(a) an aqueous medium;

(b) about 0.5 to 10 weight percent of an active-halogen composition;

(c) about 0.5 to 10 weight percent of a low-foaming sulfonate rinse agent having the formula:

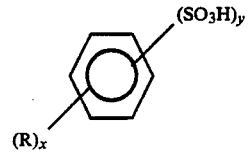

and the alkali or alkaline earth metal salts thereof wherein each x is independently an integer of 1 to 4, each y is independently an integer of 1 to 4, the sum of x and y are less than or equal to 5 and each R is independently a hydrocarbyl group containing from 3–6 carbon atoms;

(d) about 0.5 to 12 weight percent of xylene sufonate.

(e) about 0.1–15 weight percent of threshold agent selected from the group consisting of N-hydroxyethylaminodiacetic acid, and its mono, di, tri and tetrasodium salts, maleic anhydride, polyacrylic acid or polymethacrylic acid, homo or interpolymers and mixtures thereof and condensed phosphates having the following general formula:

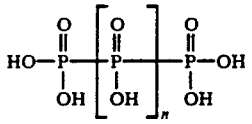

wherein, n is greater than or equal to 1 preferably n=1 to 4, and the alkali metal or alkaline earth metal salts thereof.

2. The rinse composition of claim 1 wherein the active-halogen composition comprises an alkali metal hypohalite composition.

3. The rinse composition of claim 2 wherein the alkali metal hypohalite is lithium hypochlorite, sodium hypochlorite, potassium hypochlorite, or mixtures thereof.

4. A full dilute aqueous rinse solution which comprises a sufficient amount of the the rinse composition of claim 1 to produce about 1 to 200 parts of active-halogen compound and about 1 to 200 parts of the sulfonate rinse agent each per million parts of dilute aqueous rinse solution.

5. A method for cleaning tableware in a mechanical cal dishwasher which comprises:

(a) contacting stained and soiled tableware with an aqueous alkaline cleaning composition for a sufficient time at a sufficient temperature to remove soil to produce washed tableware; and (b) contacting washed tableware with the rinse agent of claim 2 to produce washed, bleached, and rinsed tableware.

6. A low foaming, bleaching and sanitizing rinse solution for machine warewashing which consists essentially of:

(a) a major proportion of water;

(b) about 0.1 to 20 wt-% of an alkali metal hypohalite;

(c) about 0.1 to 20 wt-% of a low foaming rinse agent of the formulae:

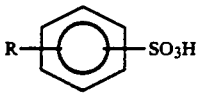

and alkali metal and alkaline earth metal salts thereof, wherein the agent is about 10% dialkylate, about 90% disulfonate, and R is an alkyl group of 3 to 6 carbon atoms;

(d) about 0.1 to 10 wt-% of a polyacrylic acid polymer having a molecular weight of about 500 to 5000; and (e) about 0.1 to 20 wt-% of a xylene sulfonate hydrotrope for the sulfonate rinse aid.

7. A rinse solution for use in the rinse cycle of a mechanical warewashing machine which comprises a major proportion of water and a sufficient amount of the agent of claim 6 to provide about 1 to 200 parts of the alkali metal hypohalite and the rinse agent per million parts of rinse solution.

8. A method of operating a mechanical warewashing machine which comprises cleaning soiled dishes with an aqueous alkaline cleaner to produce washed dishes and rinsing the washed dishes with the rinse solution of claim 6 to produce washed, bleached and rinsed ware.

9. The rinse composition of claim 1 wherein the polyelectrolyte comprises an acrylic homopolymer or interpolymer having pendant carboxyl groups, a condensed phosphate composition or mixtures thereof.

* * * * *